US008858773B2

(12) United States Patent
Nishiwaki

(10) Patent No.: US 8,858,773 B2
(45) Date of Patent: Oct. 14, 2014

(54) PLATING APPARATUS AND WIRE INSPECTION METHOD OF THE SAME

(75) Inventor: Kenichirou Nishiwaki, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 334 days.

(21) Appl. No.: 13/010,361

(22) Filed: Jan. 20, 2011

(65) Prior Publication Data

US 2011/0180411 A1 Jul. 28, 2011

(30) Foreign Application Priority Data

Jan. 27, 2010 (JP) ..... 2010-015730

(51) Int. Cl.

| | |
|---|---|
| ***C25D 21/12*** | (2006.01) |
| ***C25D 7/12*** | (2006.01) |
| ***C25D 21/18*** | (2006.01) |
| ***C25D 5/18*** | (2006.01) |
| ***C25D 17/00*** | (2006.01) |

(52) U.S. Cl.

CPC ..... *C25D 17/005* (2013.01); *C25D 21/12* (2013.01)

USPC ..... 205/83

(58) Field of Classification Search

USPC ..... 204/202, 229.7, 229.8; 205/81, 83

See application file for complete search history.

(56) References Cited

U.S. PATENT DOCUMENTS

| | | | | |
|---|---|---|---|---|
| 4,147,610 | A * | 4/1979 | Larson | 204/229.2 |
| 4,566,950 | A * | 1/1986 | Miles | 205/794.5 |
| 6,409,903 | B1 * | 6/2002 | Chung et al. | 205/96 |

FOREIGN PATENT DOCUMENTS

| | | | |
|---|---|---|---|
| CN | 101505049 | A | 8/2009 |
| JP | S58-107500 | A | 6/1983 |
| JP | S63-199165 | U | 12/1988 |
| JP | H03-120397 | A | 5/1991 |
| JP | H04-44377 | U | 4/1992 |
| JP | H06-27164 | A | 2/1994 |
| JP | H07-180097 | A | 7/1995 |
| JP | 2003321796 | A | 11/2003 |

OTHER PUBLICATIONS

Office Action issued Jan. 28, 2014 in JP Application No. 2010-015730.

Office Action issued Jun. 3, 2014 in CN Application No. 201110031594.9.

* cited by examiner

*Primary Examiner* — Keith Hendricks

*Assistant Examiner* — Stefanie S Wittenberg

(74) *Attorney, Agent, or Firm* — Panitch Schwarze Belisario & Nadel LLP

(57) ABSTRACT

When a controller turns on a relay, a closed circuit constituted by a power supply device, a wire, a resistance, a relay and wires is formed. This causes a current to flow through the closed circuit. The power supply device performs constant current control. The controller compares a measured voltage value output from a voltage detecting circuit with a preset reference voltage value. In the case of no connection failure of the wire, the measured voltage value substantially equals to the reference voltage value. In the case of connection failure of the wire, the measured voltage value is larger than the reference voltage value.

4 Claims, 5 Drawing Sheets

PLATING APPARATUS AND WIRE INSPECTION METHOD OF THE SAME

BACKGROUND OF THE INVENTION

1. Field of the Invention

The present invention relates to a plating apparatus and a wire inspection method of the same.

2. Description of the Background Art

In recent years, various types of electronic equipment employ printed circuit boards having improved density and reduced size. In manufacture of the printed circuit board, a seed layer that has previously been formed is subjected to electrolytic plating by a plating apparatus in a process of forming wiring traces, for example.

A plating apparatus described in JP 2003-321796 A, for example, includes a plating tank containing a plating solution. An anode is placed in the plating tank. A plurality of rotating bodies are provided outside the plating tank to sandwich a long-sized substrate therebetween. As the plurality of rotating bodies rotate, the long-sized substrate is transported into the plating tank through a slit formed in a side wall of the plating tank. In the state, a voltage is applied between the anode and a region of the long-sized substrate to be subjected to the electrolytic plating. In this manner, the electrolytic plating is performed on the long-sized substrate in the plating tank.

In general, the region of the long-sized substrate to be subjected to the electrolytic plating is electrically connected to a negative electrode of a DC power supply such as a rectifier through the rotating bodies and wires. In this case, the negative electrode of the DC power supply and the plurality of rotating bodies are electrically connected through the wires.

Therefore, a rotary connector, for example, is provided in each of portions where the rotating bodies are connected to the wires so as not to cause the wires to be twisted because of rotation of the plurality of rotating bodies. The rotary connector has a movable electrode capable of rotating with the rotating body, and a fixed electrode that is held still, and a conducting fluid is filled in a portion between the movable electrode and the fixed electrode. The rotating body is connected to the movable electrode, and the wire is connected to the fixed electrode. Thus, the wire can be electrically connected to the rotating body without being twisted even during rotation of the rotating body.

If the rotary connector corrodes, however, the movable electrode may not smoothly rotate relative to the fixed electrode. In this case, the fixed electrode is liable to move according to rotation of the movable electrode of the rotary connector during the rotation of the rotating body. This may result in connection failure such as disconnection or increased resistance of the wire.

The electrolytic plating cannot be performed in the case of disconnection of the wire in the plating apparatus. When a current is controlled to be constant, for example, performing the electrolytic plating in a state of increased resistance of the wire raises the voltage applied between the anode and the region of the long-sized substrate to be subjected to the electrolytic plating. This leads to lower quality of plating. Thus, the wire has to be inspected for connection failure in the plating apparatus before the electrolytic plating is performed on the long-sized substrate.

At a tip portion of the long-sized substrate that is fed from a roll, however, a nonconductive material such as polyethylene terephthalate or polypropylene is formed, and a conductive material is not formed. Accordingly, a closed circuit capable of passing the current therethrough is not formed in the plating apparatus.

Conventionally, inspection of the wire for connection failure was manually performed by a worker using a measuring instrument such as a tester. Such manual inspection is highly inefficient.

BRIEF SUMMARY OF THE INVENTION

An object of the present invention is to provide a plating apparatus capable of efficiently inspecting a wire for connection failure and a wire inspection method of the same.

(1) According to an aspect of the present invention, a plating apparatus that performs electrolytic plating on an object includes a plating tank for containing a plating solution, an anode provided in the plating tank, a conductive member capable of coming in contact with the object, a DC power supply, a wire arranged to electrically connect the DC power supply to the anode and the conductive member, a circuit for inspection configured to form a closed circuit for causing a current to flow through the wire and not through the plating solution and the object during inspection of the wire, and a detector that detects the presence/absence of connection failure of the wire in a state where the closed circuit causes the current to flow through the wire.

In the plating apparatus, the anode is provided in the plating tank containing the plating solution. The conductive member comes in contact with the object during the electrolytic plating of the object. The anode and the conductive member are each electrically connected to the DC power supply through the wire. The circuit for inspection forms the closed circuit for causing the current to flow through the wire and not through the plating solution and the object during the inspection of the wire. Accordingly, the presence/absence of connection failure of the wire is detected by the detector in the state where the current flows through the wire.

This eliminates the necessity of manually inspecting the wire for connection failure by a worker. This results in efficient inspection of the wire for connection failure. The circuit for inspection forms the closed circuit that is not routed through the plating solution and the object, thus not affecting a circuit for the electrolytic plating during the electrolytic plating. As a result, stable electrolytic plating can be performed on the object.

(2) The closed circuit may be formed to include the DC power supply.

In this case, during the inspection of the wire, the current is fed to the wire by the DC power supply used for the electrolytic plating. This eliminates the necessity of providing a DC power supply for inspection of the wire separately from the DC power supply for the electrolytic plating. Accordingly, the inspection of the wire for connection failure can be efficiently performed without increasing cost of the plating apparatus.

(3) The circuit for inspection may include a load and a switch, and the load and the switch may be connected such that the closed circuit including the load and the switch is formed when the switch is turned on.

In this case, the closed circuit including the wire, the DC power supply, the load and the switch is formed when the switch is turned on. This causes the current to flow from the DC power supply to the wire and the load. Resistance of the wire increases in the case of connection failure of the wire. Therefore, the presence/absence of connection failure of the wire can be easily determined based on change in the current or voltage caused by the increased resistance of the wire.

(4) The DC power supply may have a function of performing constant current control such that a constant current flows through the closed circuit during the inspection of the wire.

In this case, the constant current flows from the DC power supply to the wire and the load, and the load and the resistance of the wire cause a voltage drop during the inspection of the wire. In the case of connection failure of the wire, the increased resistance of the wire causes a significant voltage drop. Accordingly, the presence/absence of connection failure of the wire can be easily and accurately determined based on the voltage drop caused by the load and the resistance of the wire.

(5) The detector may detect a voltage of the DC power supply, and detect the presence/absence of connection failure of the wire based on the detected voltage.

In this case, since the constant current flows through the closed circuit, the voltage depending on the resistance of the wire is generated in the DC power supply that performs the constant current control during the inspection of the wire. Accordingly, the presence/absence of connection failure of the wire can be easily and accurately determined by detecting the voltage of the DC power supply.

(6) The detector may detect the presence of connection failure of the wire when a value of the detected voltage is larger than a value of a predetermined reference voltage.

In the case of no connection failure of the wire, the voltage of the DC power supply that performs the constant current control is substantially equal to the product of a resistance value of the load and a current value. On the other hand, in the case of connection failure of the wire, increased resistance of the wire raises the voltage of the DC power supply that performs the constant current control. Accordingly, connection failure of the wire can be reliably detected by setting the value of the reference voltage larger than the voltage of the DC power supply when connection failure of the wire is not occurring.

(7) The wire may include a first wire that connects the anode and one electrode of the DC power supply to each other and a second wire that connects the conductive member and the other electrode of the DC power supply to each other, and the switch and the load may be connected in series between the first wire and the second wire.

In this case, the closed circuit including the DC power supply, the first wire, the switch, the load and the second wire is formed during the inspection of the wire. This allows the current to flow through the first and second wires with a simple configuration.

(8) The plating apparatus may further include an output unit that outputs a detection signal when the presence of connection failure of the wire is detected by the detector.

In this case, since the detection signal is output when the presence of connection failure of the wire is detected, a worker can be easily notified of the presence of connection failure of the wire by the detection signal. Accordingly, the worker can quickly confirm the presence of connection failure of the wire.

(9) The object may be a long-sized substrate, the plating apparatus may further include a transport mechanism arranged to transport the long-sized substrate and cause the long-sized substrate to pass through the plating tank, and the conductive member may be a conductive roller provided to come in contact with the long-sized substrate transported by the transport mechanism.

In this case, during the electrolytic plating, the long-sized substrate is transported by the transport mechanism to pass through the plating tank while being in contact with the conductive roller. During the inspection of the wire, the current flows through the wire connecting each of the anode and the conductive roller to the DC power supply and not through the plating solution and the object. Accordingly, the inspection of the wire for connection failure can be efficiently performed.

(10) According to another aspect of the present invention, a wire inspection method of a plating apparatus for inspecting a wire, which electrically connects a DC power supply to an anode provided in a plating tank of the plating apparatus and to a conductive member capable of coming in contact with an object, for connection failure includes the steps of forming a closed circuit that causes a current to flow through the wire and not through a plating solution and the object during inspection of the wire, and detecting the presence/absence of connection failure of the wire in a state where the closed circuit causes the current to flow through the wire.

In the wire inspection method of the plating apparatus, the closed circuit for causing the current to flow through the wire and not through the plating solution and the object is formed. Accordingly, the presence/absence of connection failure of the wire in the state where the current flows through the wire is detected.

This eliminates the necessity of manually inspecting the wire for connection failure by a worker. This results in efficient inspection of the wire for connection failure. The closed circuit that is not routed through the plating solution and the object is formed, thus not affecting a circuit for the electrolytic plating during the electrolytic plating. As a result, stable electrolytic plating can be performed on the object.

Other features, elements, characteristics, and advantages of the present invention will become more apparent from the following description of preferred embodiments of the present invention with reference to the attached drawings.

DETAILED DESCRIPTION OF THE INVENTION

Figure 1:
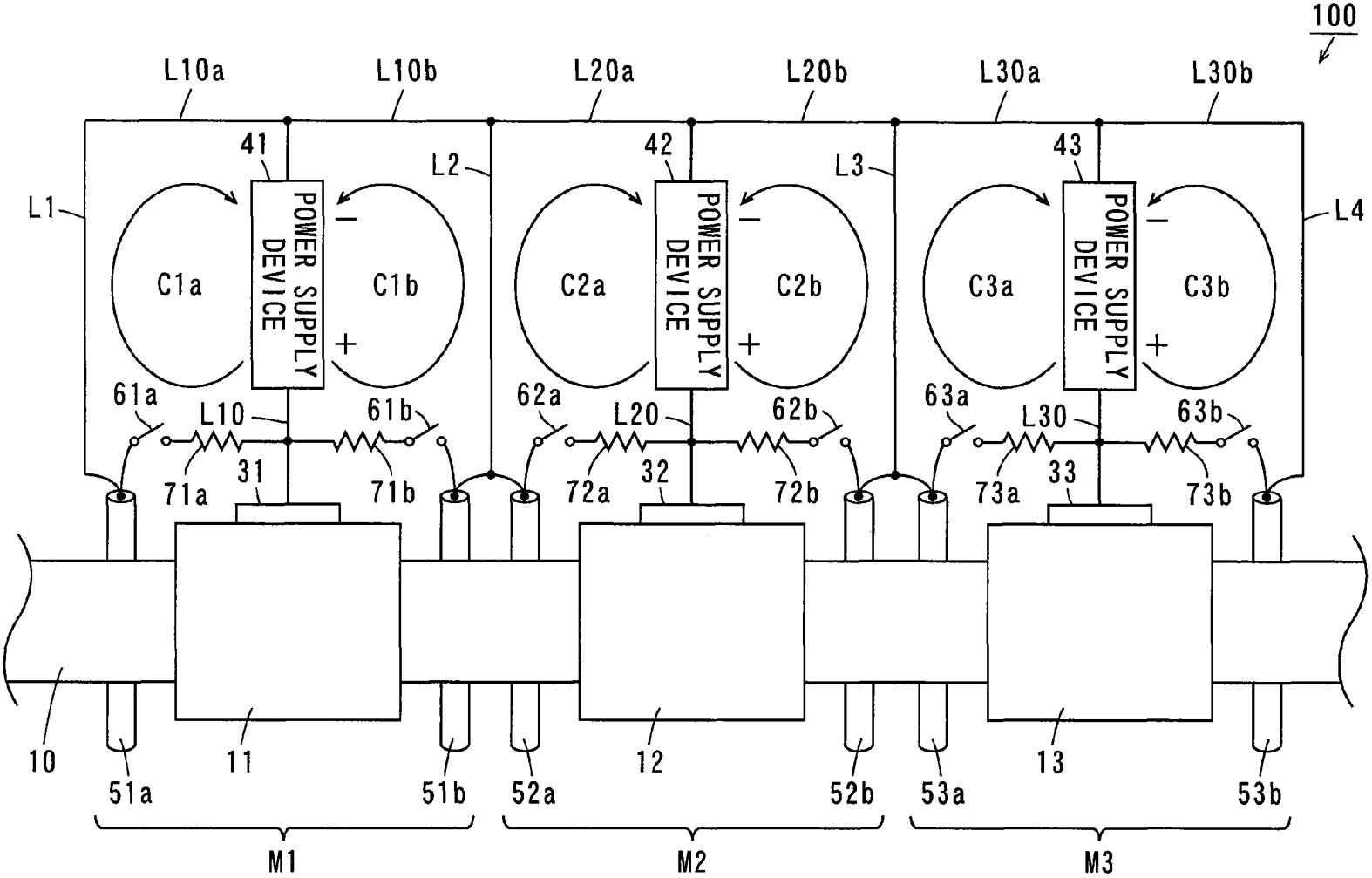
FIG. 1 is a schematic diagram of a plating apparatus according to one embodiment of the present invention.

Description will be made of a plating apparatus and a wire inspection method of the plating apparatus according to one embodiment of the present invention while referring to the drawings.

(1) General Configuration of the Plating Apparatus

FIG. 1 is a schematic diagram of the plating apparatus according to the one embodiment of the present invention.

As shown in FIG. 1, the plating apparatus 100 includes a plurality of plating units M1, M2, M3. The plating unit M1 includes a plating tank 11, an anode 31, a power supply device 41 and power feed rollers 51*a*, 51*b*. The plating unit M2 includes a plating tank 12, an anode 32, a power supply device 42 and power feed rollers 52*a*, 52*b*. The plating unit M3 includes a plating tank 13, an anode 33, a power supply device 43 and power feed rollers 53*a*, 53*b*.

A positive electrode of the power supply device 41 is connected to the anode 31 through a wire L10. A negative electrode of the power supply device 41 is connected to the power feed roller 51*a* through a wire L10*a* and a wire L1 while being connected to the power feed roller 51*b* through a wire L10*b* and a wire L2.

Similarly, a positive electrode of the power supply device 42 is connected to the anode 32 through a wire L20. A negative electrode of the power supply device 42 is connected to the power feed roller 52*a* through a wire L20*a* and the wire L2 while being connected to the power feed roller 52*b* through a wire L20*b* and a wire L3.

A positive electrode of the power supply device 43 is connected to the anode 33 through a wire L30. A negative electrode of the power supply device 43 is connected to the power feed roller 53*a* through a wire L30*a* and the wire L3 while being connected to the power feed roller 53*b* through a wire L30*b* and a wire L4.

Rotary connectors are provided in respective portions where the power feed rollers 51*a*, 51*b*, 52*a*, 52*b*, 53*a*, 53*b* and the wires L1, L2, L3, L4 are connected.

A relay (electromagnetic switch) 61*a* and a resistance 71*a* are connected in series between the rotary connector of the power feed roller 51*a* and the anode 31. A relay 61*b* and a resistance 71*b* are connected in series between the rotary connector of the power feed roller 51*b* and the anode 31. When the relay 61*a* is turned on, a closed circuit C1*a* constituted by the power supply device 41, the wire L10, the resistance 71*a*, the relay 61*a* and the wires L1, L10*a* is formed. When the relay 61*b* is turned on, a closed circuit C1*b* constituted by the power supply device 41, the wire L10, the resistance 71*b*, the relay 61*b* and the wires L2, L10*b* is formed.

Similarly, a relay 62*a* and a resistance 72*a* are connected in series between the rotary connector of the power feed roller 52*a* and the anode 32. A relay 62*b* and a resistance 72*b* are connected in series between the rotary connector of the power feed roller 52*b* and the anode 32. When the relay 62*a* is turned on, a closed circuit C2*a* constituted by the power supply device 42, the wire L20, the resistance 72*a*, the relay 62*a* and the wires L2, L20*a* is formed. When the relay 62*b* is turned on, a closed circuit C2*b* constituted by the power supply device 42, the wire L20, the resistance 72*b*, the relay 62*b* and the wires L3, L20*b* is formed.

A relay 63*a* and a resistance 73*a* are connected in series between the rotary connector of the power feed roller 53*a* and the anode 33. A relay 63*b* and a resistance 73*b* are connected in series between the rotary connector of the power feed roller 53*b* and the anode 33. When the relay 63*a* is turned on, a closed circuit C3*a* constituted by the power supply device 43, the wire L30, the resistance 73*a*, the relay 63*a* and the wires L3, L30*a* is formed. When the relay 63*b* is turned on, a closed circuit C3*b* constituted by the power supply device 43, the wire L30, the resistance 73*b*, the relay 63*b* and the wires L4, L30*b* is formed.

A circuit for inspection is constituted by the relays 61*a*, 61*b*, 62*a*, 62*b*, 63*a*, 63*b* and the resistances 71*a*, 71*b*, 72*a*, 72*b*, 73*a*, 73*b* in the present embodiment.

(2) Details of the Plating Apparatus

Figure 2:
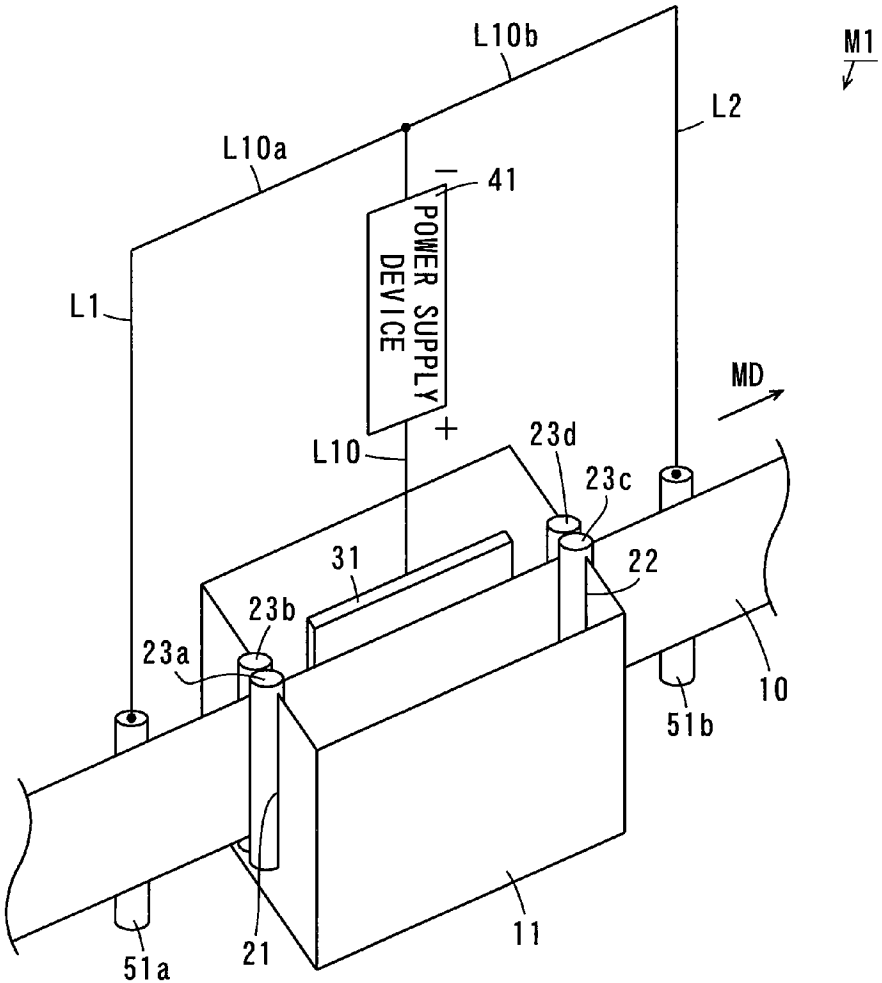
FIG. 2 is a schematic perspective view of one plating unit of the plating apparatus of FIG. 1.

FIG. 2 is a schematic perspective view of one plating unit of the plating apparatus 100 of FIG. 1. FIG. 2 shows the plating unit M1 of FIG. 1. The relays 61*a*, 61*b* and the resistances 71*a*, 71*b* of FIG. 1 are not shown in FIG. 2.

As shown in FIG. 2, the plating unit M1 includes the box-shaped plating tank 11. The plating tank 11 has a bottom surface portion and four side surface portions. Long-sized openings 21, 22 extending in a vertical direction are provided in two side surface portions, respectively, of the plating tank 11 that are opposite to each other.

A pair of transport rollers 23*a*, 23*b* extending in the vertical direction is rotatably provided to close the one opening 21, and a pair of transport rollers 23*c*, 23*d* extending in the vertical direction is rotatably provided to close the other opening 22. In this case, the two openings 21, 22 are sealed in a liquid-tight manner by the transport rollers 23*a* to 23*d*.

A plating solution including copper sulfate, for example, is contained in the plating tank 11. When the plating solution contains insufficient copper ions, powdered copper oxide may be added to the plating solution. A storing tank (not shown) that receives the plating solution leaking out of the plating tank 11 may be arranged below the plating tank 11. In the case, the plating solution accumulating in the storing tank is returned to the plating tank 11 by a pump.

A long-sized substrate 10 is sandwitched between the pair of transport rollers 23*a*, 23*b* and between the pair of transport rollers 23*c*, 23*d*. The transport rollers 23*a* to 23*d* and the power feed rollers 51*a*, 51*b* rotate, thereby causing the long-sized substrate 10 to pass through the plating tank 11 and to be transported in a direction indicated by an arrow MD (hereinafter referred to as a transport direction). Accordingly, the long-sized substrate 10 is successively immersed in the plating solution in the plating tank 11.

The power feed roller 51*a* is provided upstream of the transport rollers 23*a*, 23*b* in the transport direction of the long-sized substrate 10 while being rotatable around its axis in the vertical direction. The power feed roller 51*b* is provided downstream of the transport rollers 23*c*, 23*d* in the transport direction of the long-sized substrate 10 while being rotatable around its axis in the vertical direction.

The power feed rollers 51*a*, 51*b* rotate while being in contact with one surface of the long-sized substrate. A plating region to be subjected to electrolytic plating is provided on the one surface of the long-sized substrate 10. The power feed rollers 51*a*, 51*b* are in contact with the one surface of the long-sized substrate 10, so that each of the power feed rollers 51*a*, 51*b* is electrically connected to the plating region of the long-sized substrate 10. The power feed roller 51*a* is connected to the negative electrode of the power supply device 41 through the wires L1, L10*a*. The power feed roller 51*b* is connected to the negative electrode of the power supply device 41 through the wires L2, L10*b*. The power supply device 41 is connected to an AC power supply (not shown).

The anode 31 is provided along the long-sized substrate 10 within the plating tank 11. In this case, the anode 31 is arranged to be opposite and close to the one surface (the surface on which the plating region is provided) of the long-sized substrate 10. Titanium coated with iridium oxide is used as the anode 31, for example. The anode 31 is connected to the positive electrode of the power supply device 41 through the wire L10.

The power supply device 41 applies a voltage between the anode 31 and the power feed rollers 51*a*, 51*b* such that the plating region of the long-sized substrate 10 electrically connected to the power feed rollers 51*a*, 51*b* acts as a negative pole (cathode). Accordingly, the plating region of the long-sized substrate 10 is subjected to the electrolytic plating. In this case, the power supply device 41 performs constant current control such that a constant current flows through the plating region of the long-sized substrate 10.

(3) Operation of the Plating Apparatus

Figure 3:
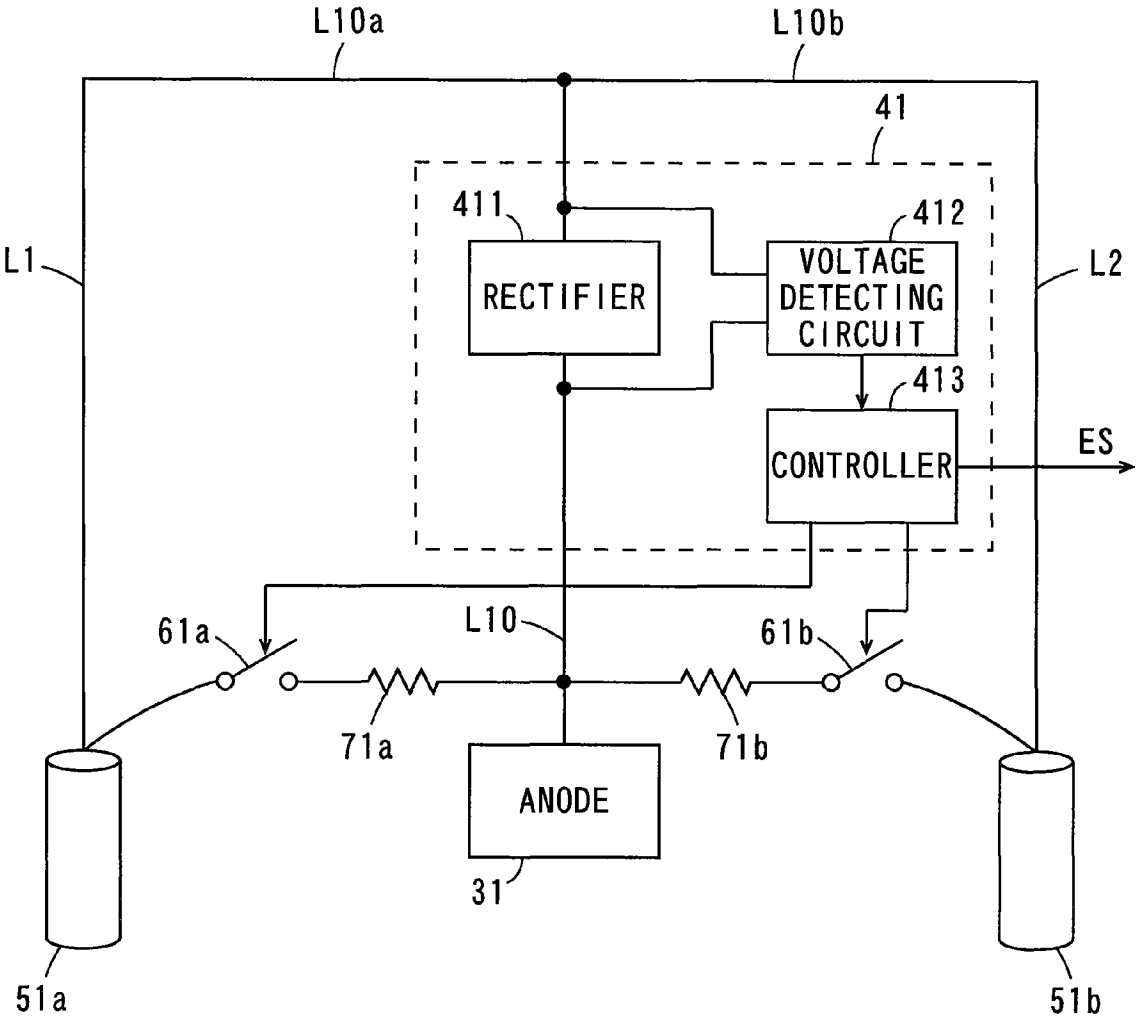
FIG. 3 is a block diagram showing the configuration of an electrical system of the one plating unit of the plating apparatus of FIG. 1.

FIG. 3 is a block diagram showing the configuration of an electrical system of the one plating unit M1 in the plating apparatus 100 of FIG. 1. The configurations of the other plating units M2, M3 in the plating apparatus 100 of FIG. 1 are the same as the configuration of the plating unit M1 of FIG. 3.

As shown in FIG. 3, the power supply device 41 includes a rectifier 411, a voltage detecting circuit 412 and a controller 413.

The rectifier 411 rectifies an alternating current supplied from the AC power supply into a direct current, and applies a direct-current voltage between the anode 31 and the power feed rollers 51*a*, 51*b*. The rectifier 411 has a constant current controlling function for controlling the current flowing through the wire L10 to be constant.

During the electrolytic plating, the rectifier 411 supplies the constant direct current to the wire L10, the anode 31, the plating solution in the plating tank 11, the long-sized substrate 10, the power feed rollers 51*a*, 51*b*, and the wires L1, L2, L10*a*, L10*b*.

The voltage detecting circuit 412 detects a voltage between a positive electrode and a negative electrode of the rectifier 411, and outputs a detected value (hereinafter referred to as a measured voltage value) to the controller 413. The controller 413 is composed of a CPU (Central Processing Unit) and a memory or composed of a microcomputer or the like, and turns on and off the relays 61*a*, 61*b* at timings set based on user's operation or at preset timings. The controller 413 determines the presence/absence of connection failure of the wire based on the voltage value output from the voltage detecting circuit 412.

Here, connection failure is not limited to a disconnected state of the wire. Connection failure also refers to a state of increased resistance of the wire due to partial disconnection of the wire, and a state of increased resistance of the wire due to contact failure of the connection portion of the wire.

During the wire inspection, the controller 413 first turns on the relay 61*a*. Thus, the closed circuit C1*a* (see FIG. 1) constituted by the rectifier 411 of the power supply device 41, the wire L10, the resistance 71*a*, the relay 61*a* and the wires L1, L10*a* is formed. This causes the current to flow through the closed circuit C1*a*. The rectifier 411 performs the constant current control such that the current flowing through the closed circuit C1*a* is constant.

The controller 413 compares the measured voltage value output from the voltage detecting circuit 412 with a preset reference voltage value. The reference voltage value is set to the product of a resistance value of the resistance 71*a* and a value of the current supplied by the rectifier 411.

Here, the resistances 71*a*, 71*b*, 72*a*, 72*b*, 73*a*, 73*b* of FIG. 1 have respective resistance values. When the resistance value of the resistance 71*a* is 0.5Ω and the value of the current supplied by the rectifier 411 is 0.5 A, the reference voltage value is 0.25 V, for example.

In the case of no connection failure of the wires L10, L1, L10*a*, the measured voltage value is substantially equal to the reference voltage value. Meanwhile, in the case of connection failure of any portion of the wires L10, L1, L10*a*, the resistance value of the any portion of the wires L10, L1, L10*a* increases, so that the measured voltage value becomes larger than the reference voltage value. For example, in the case of partial disconnection of any portion of the wires L10, L1, L10*a*, the measured voltage value is higher than the reference voltage value by several tens of percent. In the case of disconnection of any portion of the wires L10, L1, L10*a*, the measured voltage value rises to an upper limit of detection.

The controller 413 outputs an abnormality detection signal ES indicating the presence of connection failure of the wire when the measured voltage value is higher than the reference voltage value. The controller 413 then turns off the relay 61*a*.

Next, the controller 413 turns on the relay 61*b*. Accordingly, the closed circuit C1*b* (see FIG. 1) constituted by the rectifier 411 of the power supply device 41, the wire L10, the resistance 71*b*, the relay 61*b* and the wires L2, L10*b* is formed. This causes the current to flow through the closed circuit C1*b*. The rectifier 411 performs the constant current control such that the current flowing through the closed circuit C1*b* is constant.

The controller 413 compares the measured voltage value output from the voltage detecting circuit 412 with the reference voltage value, and outputs the abnormality detection signal ES when the measured voltage value is higher than the reference voltage value. The controller 413 then turns off the relay 61*b*.

The abnormality detection signal ES output from the controller 413 is given to external equipment such as a personal computer. Based on the abnormality detection signal ES, the external equipment shows on its display information indicating the presence of connection failure of the wire in the plating unit M1 and the plating unit M1 having the connection failure, or generates a warning sound indicating the presence of connection failure of the wire.

The same wire inspection is also performed on the other plating units M2, M3 of FIG. 1. In this case, the wire inspection may be sequentially performed in the plating units M1, M2, M3 when the relays 61*a*, 61*b*, 62*a*, 62*b*, 63*a*, 63*b* of the plating units M1, M2, M3 are sequentially turned on. Alternatively, the relays 61*a*, 62*a*, 63*a* of the plating units M1, M2, M3 may be simultaneously turned on, and then the relays 61*b*, 62*b*, 63*b* of the plating units M1, M2, M3 may be simultaneously turned on.

The resistances 71*a*, 71*b*, 72*a*, 72*b*, 73*a*, 73*b* of FIG. 1 may have different resistance values. In the case, reference voltage values are set corresponding to the resistances 71*a*, 71*b*, 72*a*, 72*b*, 73*a*, 73*b*, respectively.

The resistance values of the resistances 71*a*, 71*b*, 72*a*, 72*b*, 73*a*, 73*b* and the value of the current supplied by the rectifier 411 during the wire inspection can be arbitrarily set. In this case, each of the products of the resistance values of the resistances 71*a*, 71*b*, 72*a*, 72*b*, 73*a*, 73*b* and the value of the current supplied by the rectifier 411 is set so as not to exceed a rated voltage of the rectifier 411.

The value of the current supplied by the rectifier 411 is preferably set as small as about 0.1 A to 0.5 A especially for the purpose of detecting the presence/absence of disconnection of the wire.

The reference voltage value may be set to a value that is larger by a given allowance than each of the products of the resistance values of the resistances 71*a*, 71*b*, 72*a*, 72*b*, 73*a*, 73*b* and the value of the current supplied by the rectifier 411. This suppresses erroneous determination of connection failure due to a detection error of the voltage.

In practice, a switch for switching the rectifier 411 on and off is provided. During the wire inspection, the rectifier 411 may be switched on and off every time the relays 61*a*, 61*b*, 62*a*, 62*b*, 63*a*, 63*b* are switched on and off. Alternatively, only the relays 61*a*, 61*b*, 62*a*, 62*b*, 63*a*, 63*b* may be switched on and off while the rectifier 411 is turned on.

(4) Effects of the Embodiment

In the plating apparatus 100 according to the present embodiment, the closed circuits C1*a*, C1*b*, C2*a*, C2*b*, C3*a*, C3*b* are formed in the plurality of plating units M1, M2, M3 when the relays 61*a*, 61*b*, 62*a*, 62*b*, 63*a*, 63*b* are turned on, and the wires are inspected for the presence/absence of connection failure based on the measured voltage values output from the voltage detecting circuits 412. This eliminates the necessity of manually inspecting the wires for connection failure by a worker. This allows for efficient inspection of the wires for connection failure.

The controller 413 outputs the abnormality detection signal ES when the connection failure of the wire is detected in any of the plating units M1, M2, M3. In this case, the external equipment can show the information indicating the presence of connection failure of the wire and the plating unit having the connection failure of the wire based on the abnormality detection signal ES. This allows the worker to quickly confirm where the connection failure of the wire is occurring. Also, the external equipment can output the warning sound indicating the presence of connection failure of the wire based on the abnormality detection signal ES. Thus, the worker can quickly confirm the presence of connection failure of the wire.

When the wire inspection is finished, all the relays 61*a*, 61*b*, 62*a*, 62*b*, 63*a*, 63*b* are turned off. That is, the closed circuits C1*a*, C1*b*, C2*a*, C2*b*, C3*a*, C3*b* are not formed. Accordingly, the resistances 71*a*, 71*b*, 72*a*, 72*b*, 73*a*, 73*b* and the relays 61*a*, 61*b*, 62*a*, 62*b*, 63*a*, 63*b* for the wire inspection are independent from a circuit for the electrolytic plating. Therefore, the circuit for the wire inspection does not affect the electrolytic plating. For example, the current is not reduced during the electrolytic plating because of the circuit for the wire inspection. This allows for stable electrolytic plating on the long-sized substrate 10.

(5) Another Example of the Configuration of the Plating Apparatus

Figure 4:
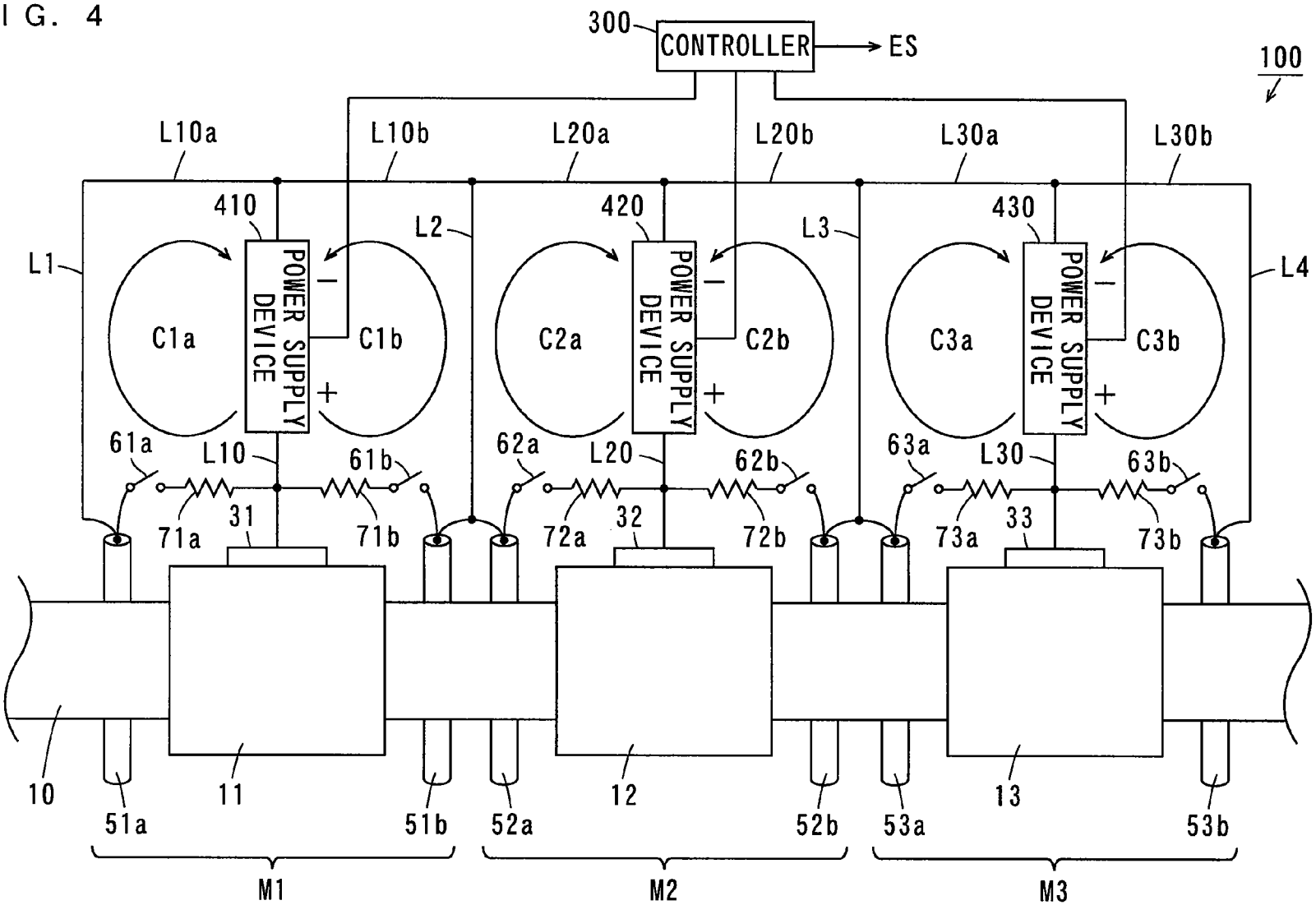
FIG. 4 is a schematic diagram showing another example of the configuration of the plating apparatus.

FIG. 4 is a schematic diagram showing another example of the configuration of the plating apparatus. The plurality of plating units M1, M2, M3 include respective power supply devices 410, 420, 430 in the plating apparatus 100 of FIG. 4. The power supply devices 410, 420, 430 do not include the controller 413 of FIG. 3. A controller 300 is provided in common for the plurality of plating units M1, M2, M3.

The controller 300 controls the relays 61*a*, 61*b* of the plating unit M1, the relays 62*a*, 62*b* of the plating unit M2, and the relays 63*a*, 63*b* of the plating unit M3 to be turned on and off. The controller 300 determines the presence/absence of connection failure of the wire based on the voltage value output from the voltage detecting circuits 412 (see FIG. 3) of the plurality of power supply devices 410, 420, 430.

In the plating apparatus 100 of this example, the common controller 300 can automatically execute the wire inspection on the plurality of plating units M1, M2, M3.

Figure 5:
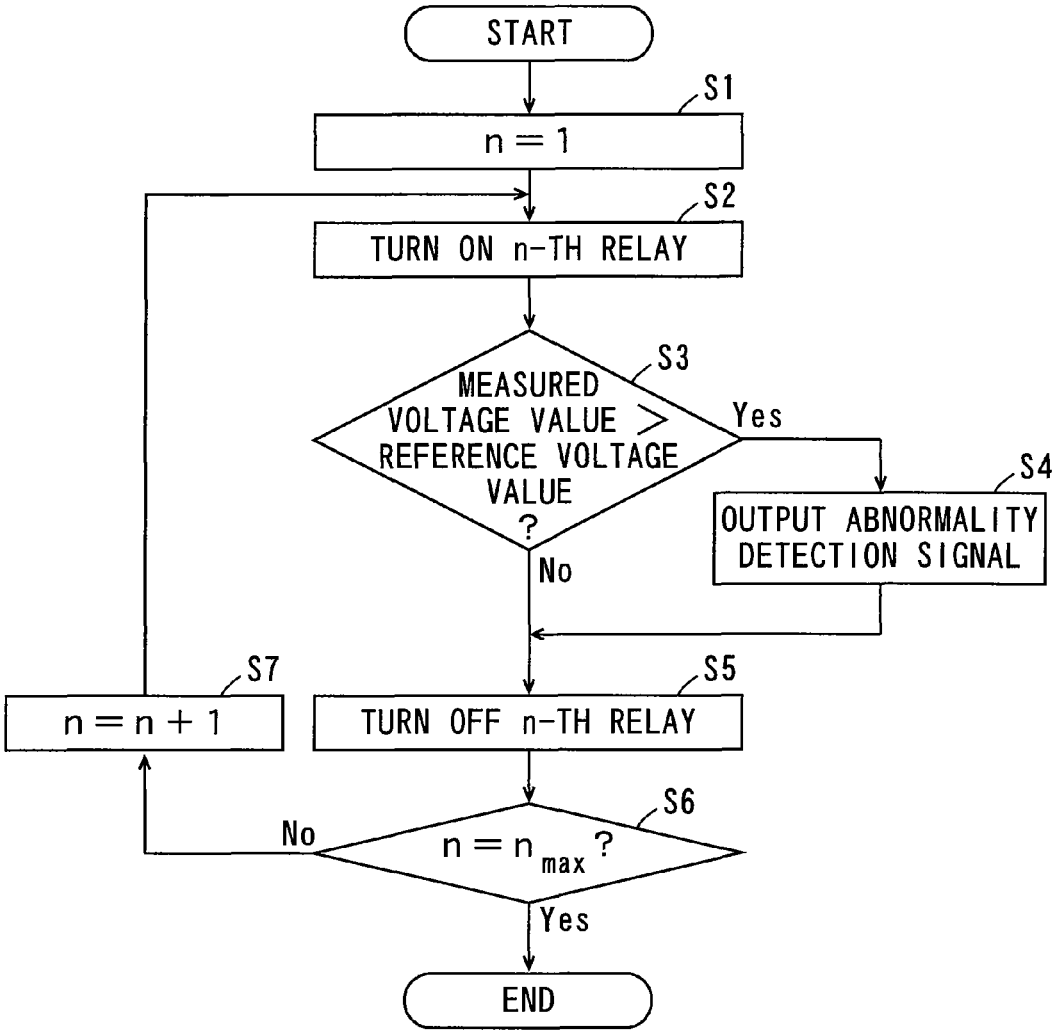
FIG. 5 is a flowchart showing operation of a controller in the plating apparatus of FIG. 4.

FIG. 5 is a flowchart showing operation of the controller 300 in the plating apparatus 100 of FIG. 4.

In the following description, the plurality of relays are referred to as the first to the $n_{max}$-th relays. $n_{max}$ is equal to the number of the plurality of relays. In the example of FIG. 4, the relays 61*a*, 61*b*, 62*a*, 62*b*, 63*a*, 63*b* are referred to in this order as the first to sixth relays. In FIG. 5, a variable n is a natural number of not less than one and not more than $n_{max}$.

In an initial state, the plurality of relays 61*a*, 61*b*, 62*a*, 62*b*, 63*a*, 63*b* are turned off.

As shown in FIG. 5, first, the controller 300 sets the variable n to one (Step S1). Next, the controller 300 turns on the n-th relay (Step S2). Initially, the controller 300 turns on the first relay (the relay 61*a* of FIG. 4). This causes the closed circuit C1*a* to be formed. At this time, the rectifier 411 of the power supply device 410 performs the constant current control such that the constant current flows through the closed circuit C1*a*.

The controller 300 subsequently determines whether or not the measured voltage value output from the voltage detecting circuit of the power supply device is larger than the reference voltage value (Step S3). Initially, the controller 300 determines whether or not the measured voltage value output from the voltage detecting circuit 412 of the power supply device 410 of the plating unit M1 is larger than the reference voltage value.

When the measured voltage value is larger than the reference voltage value, the controller 300 outputs the abnormality detection signal ES (Step S4). In this case, the abnormality detection signal ES may include the information indicating the presence of connection failure of the wire and the plating unit having the connection failure of the wire. Then, the controller 300 proceeds to a process of Step S5.

When the measured voltage value is not more than the reference voltage value in Step S3, the controller 300 proceeds to the process of Step S5.

The controller 300 turns off the n-th relay (Step S5). Initially, the controller 300 turns off the first relay (the relay 61*a* of FIG. 4).

Then, the controller 300 determines whether or not the variable n is equal to $n_{max}$ (Step S6). When the variable n is not equal to $n_{max}$, the controller 300 adds one to the variable n (Step S7), and returns to the process of Step S2. Since the variable n is initially set to one, the controller 300 sets the variable n to two, and returns to the process of Step S2.

The controller 300 repeats the processes of Steps S2 to S7 until the variable n is equal to $n_{max}$. This causes the plurality of relays to be sequentially turned on and off. In the example of FIG. 4, the plurality of relays 61*a*, 61*b*, 62*a*, 62*b*, 63*a*, 63*b* are sequentially turned on, and the closed circuits C1*a*, C1*b*, C2*a*, C2*b*, C3*a*, C3*b* are sequentially formed in the plating units M1, M2, M3. Accordingly, the wire inspection is automatically performed in sequence on the plurality of plating units M1, M2, M3. This further reduces operations to be performed by the worker during the wire inspection.

(6) Other Embodiments (a) While the plating apparatus 100 according to the above-described embodiment includes the plurality of plating units M1, M2, M3, the plating apparatus 100 may include one plating unit.

(b) While the power supply devices 41, 42, 43 and the power supply devices 410, 420, 430 each include the voltage detecting circuit 412 in the plating apparatus 100 according to the present embodiment, a common voltage detecting circuit may be used for the plurality of power supply devices 41, 42, 43 or the plurality of power supply devices 410, 420, 430. In this case, the common voltage detecting circuit is sequentially connected to the plurality of power supply devices 41, 42, 43 or the plurality of power supply devices 410, 420, 430 using a switching circuit constituted by a switch and so on.

(c) A switching element such as a transistor or a mechanical switch may be used instead of the relays 61*a*, 61*b*, 62*a*, 62*b*, 63*a*, 63*b* in the plating apparatus 100 according to the above-described embodiment.

(d) Another load element such as a transistor or an inductor may be used instead of the resistances 71*a*, 71*b*, 72*a*, 72*b*, 73*a*, 73*b* in the plating apparatus 100 according to the above-described embodiment.

(7) Correspondences Between Elements in the Claims and Parts in Embodiments

In the following paragraphs, non-limiting examples of correspondences between various elements recited in the claims below and those described above with respect to various preferred embodiments of the present invention are explained.

In the above-described embodiment, the plating tanks 11, 12, 13 are examples of a plating tank, the anodes 31, 32, 33 are examples of an anode, the power feed rollers 51*a*, 51*b*, 52*a*, 52*b*, 53*a*, 53*b* are examples of a conductive member or a conductive roller, and the rectifiers 411 of the power supply devices 41, 42, 43, 410, 420, 430 are examples of a DC power supply.

The wires L1, L2, L3, L4, L10, L20, L30, L10*a*, L10*b*, L20*a*, L20*b*, L30*a*, L30*b* are examples of a wire, the resistances 71*a*, 71*b*, 72*a*, 72*b*, 73*a*, 73*b* and the relays 61*a*, 61*b*, 62*a*, 62*b*, 63*a*, 63*b* are an example of a circuit for inspection, the closed circuits C1*a*, C1*b*, C2*a*, C2*b*, C3*a*, C3*b* are examples of a closed circuit, and the voltage detecting circuit 412 is an example of a detector.

The resistances 71*a*, 71*b*, 72*a*, 72*b*, 73*a*, 73*b* are examples of a load, the relays 61*a*, 61*b*, 62*a*, 62*b*, 63*a*, 63*b* are examples of a switch, the wires L10, L20, L30 are examples of a first wire, the wires L1, L2, L3, L4, L10*a*, L10*b*, L20*a*, L20*b*, L30*a*, L30*b* are examples of a second wire, the controllers 413, 300 are examples of an output unit, the abnormality detection signal ES is an example of a detection signal, the long-sized substrate 10 is an example of an object or a long-sized substrate, and the transport rollers 23*a*, 23*b*, 23*c*, 23*d* are an example of a transport mechanism.

As each of various elements recited in the claims, various other elements having configurations or functions described in the claims can be also used.

While preferred embodiments of the present invention have been described above, it is to be understood that variations and modifications will be apparent to those skilled in the art without departing the scope and spirit of the present invention. The scope of the present invention, therefore, is to be determined solely by the following claims.

I claim:

1. A plating apparatus that performs electrolytic plating on an object, comprising:

a plating tank for containing a plating solution;

an anode provided in said plating tank;

a conductive member capable of coming in contact with said object;

a DC power supply;

a first wire arranged to electrically connect the anode and one electrode of the DC power supply;

a second wire arranged to connect the conductive member and another electrode of the DC power supply;

a circuit for inspection; and a detector that detects the presence/absence of connection failure of the first and second wires, wherein the circuit for inspection includes a load and a switch that are connected in series between the anode and the conductive member, the switch having (i) an off position wherein the load is not electrically coupled to the conductive member or the anode during plating of the object, and (ii) an on position wherein the load is electrically coupled to the conductive member and the anode during inspection of the first and second wires, the DC power supply having a function of performing constant current control such that a constant current flows through said load during the inspection of said first and second wires, and the detector detects a voltage of the DC power supply during the inspection of the first and second wires, and detects the presence or absence of a connection failure of the first and second wires based on the detected voltage.

2. The plating apparatus according to claim 1, wherein said detector detects the presence of connection failure of the first and second wires when a value of said detected voltage is larger than a value of a predetermined reference voltage.

3. The plating apparatus according to claim 1, further comprising an output unit that outputs a detection signal when the presence of connection failure of the first and second wires is detected by said detector.

4. The plating apparatus according to claim 1, wherein said object is a long-sized substrate, said plating apparatus further includes a transport mechanism arranged to transport said long-sized substrate and cause said long-sized substrate to pass through said plating tank, and said conductive member is a conductive roller provided to come in contact with the long-sized substrate transported by said transport mechanism.

* * * * *